US006006530A

United States Patent [19]

Lee et al.

[11] Patent Number: 6,006,530

[45] Date of Patent: Dec. 28, 1999

[54] REFRIGERATOR DRIVING CONTROL APPARATUS AND METHOD THEREOF

[75] Inventors: Jang-Hee Lee, Anyang; Sung-Ho Cho, Suwon, both of Rep. of Korea

[73] Assignee: Samsung Electronics Co., Ltd., Suwon, Rep. of Korea

[21] Appl. No.: 09/008,476

[22] Filed: Jan. 16, 1998

[30] Foreign Application Priority Data

May 15, 1997 [KR] Rep. of Korea ..... 97-18801

[51] Int. Cl.[6] ..... F25D 17/08

[52] U.S. Cl. ..... 62/187

[58] Field of Search ..... 62/186, 89, 187

[56] References Cited

U.S. PATENT DOCUMENTS

| | | | |
|---|---|---|---|
| 3,384,801 | 5/1968 | Rodgers | 62/186 |
| 4,459,519 | 7/1984 | Erdman | 318/254 |
| 4,732,009 | 3/1988 | Frohbieter | 62/89 |
| 5,228,300 | 7/1993 | Shim | 62/80 |
| 5,255,530 | 10/1993 | Janke | 62/180 |
| 5,269,152 | 12/1993 | Park | 62/89 |
| 5,799,496 | 9/1998 | Park et al. | 62/89 |

FOREIGN PATENT DOCUMENTS

| | | | |
|---|---|---|---|
| 403122478 | 5/1991 | Japan | 62/186 |
| 404093576 | 3/1992 | Japan | 62/186 |

*Primary Examiner*—William Doerrler

*Attorney, Agent, or Firm*—Burns, Doane, Swecker & Mathis, L.L.P.

[57] ABSTRACT

A refrigerator has an evaporator to discharge cold air into a food storage chamber by rotation of a fan as the cold air is generated during circulation of a coolant, and a temperature detecting unit to detect the temperature of the evaporator and generate a signal related to the evaporator temperature. The fan is controlled to initially rotate at a low speed (when the evaporator is warmest) and then at a progressively increasing speed. The increasing speed is independent of the temperature of the food storage chamber. The speed could be increased in response to detected decreases in the evaporator temperature. Alternatively, the speed could increase automatically for a predetermined time period.

7 Claims, 5 Drawing Sheets

REFRIGERATOR DRIVING CONTROL APPARATUS AND METHOD THEREOF

BACKGROUND OF THE INVENTION

1. Field of the Invention

The present invention relates to a refrigerator, and more particularly to a refrigerator driving control apparatus and method thereof to control the rotation speed of an air blowing fan, thereby improving cooling efficiency and reducing power consumption.

2. Description of the Prior Art

In general, a refrigerator, as shown in FIG. 1, is provided with spaces divided by an intermediate member(20) into two, an upper space(30) for freezing food and a lower space(40) for refrigerating the food at storage containers, cold air circulating means(50) disposed at the rear portion of a freezing chamber(30) for compulsorily circulating air current, and a damper(60) installed on the rear wall of the cabinet(10) at a predetermined interval with a cold air discharge hole(61) and a cold air suction hole(62) for forming a cold air circulation route in which the cold air blown by the cold air circulating means(50) is guided and, at the same time, discharged upward and sucked downward the freezing chamber(30).

At this time, the cold air circulating means(50) comprises an air blowing fan motor(51) driven as power is applied, an air blowing fan(52) rotated as the air blowing motor(51) is driven, and a bracket(53) to fix the air blowing fan motor (51) on the cabinet(53).

A evaporator(70) is installed under the cold air circulating means(50) for repeatedly heat-exchanging the air at the freezing chamber(30) and refrigerating chamber(40) into cold air, a defrosting heater(80) installed under the evaporator(70) to be turned on and off for removing the frost formed at the surface of the evaporator(70), and a water drain hose(90) connected from the defrosting heater(80) along the rear wall of the cabinet(10) for discharging out the water during the defrosting operation.

An evaporating dish(110) is installed under the water drain hose(90) at the machine room(100) formed at the lower rear part of the cabinet(10) for collecting the water discharged along the water drain hose(90) and for vaporizing the collected water with the compressing heat of a compressor. The compressor(120) is installed under the evaporating dish(110) for compressing into a coolant of high temperature and high pressure, and a concentrator(130) is disposed at the rear outer surface of the cabinet(10) for condensing the compressed gas coolant of high temperature and high pressure by natural convection.

On the other hand, there are provided a first cold air pass(150) formed at a rear part of the intermediate member (20) at a predetermined interval on a cold air flow guiding plate(140) for discharging cold air heat-exchanged at the evaporator(70) toward the refrigerating chamber(40), a second cold air pass(160) formed at another rear part of the intermediate member(20) at a predetermined interval for passing the cold air of the refrigerating chamber40) through the evaporator(70), and a temperature control apparatus (170) assembled at the rear upper end of the refrigerating chamber(40) for controlling supply of the amount of the cold air discharged through the first cold air pass(150) to the refrigerating chamber(40) in a plurality of steps (for instance, strong cooling, weak cooling, etc.).

Unexplained numerals, 180 and 181, are respectively a freezing chamber door and a refrigerating chamber door hinged at the freezing chamber(30) and the refrigerating chamber(40) in an opening and closing manner, and 190 is a shelf member to put the food containers with selective vertical mobility.

Here, an air blowing control apparatus, as shown in FIG. 2, is to drive the air blowing fan motor(51) and to rotate the air blowing fan(52) including a relay driving element(53) for transmitting a predetermined level of alternating current voltage (VAC) input from a power source to the air blowing motor(51) as the relay(54) is turned on or off according to a control signal sent from a control unit (not shown).

Next, operational procedures of the refrigerator is described below. First of all, when the temperature at the freezing chamber(30) and the refrigerating chamber(40) is manually set with a temperature selection key (not shown), the chamber temperature is detected by a chamber temperature detecting unit (not shown). If the detected chamber temperature is higher than the set chamber temperature, the compressor(120) (not shown) is driven.

If the compressor(120) is driven, a coolant is compressed into the gas coolant of high temperature and high pressure, thereby vaporizing the defrosted water collected at the evaporating dish(110) as passing through the condenser (not shown). The coolant passed through the concentrator(130) is cooled and liquefied into the liquid coolant of low temperature and high pressure as the coolant is heat-exchanged with outside air in natural convection or compulsory convection.

The liquid coolant of low temperature and high pressure is changed into the frosty coolant of low temperature and high pressure which is easy to be vaporized as it is passed through a capillary tube (not shown) where the coolant is expanded to reach vaporization pressure. Then, the frosty coolant is infused into the evaporator(70).

Accordingly, the frosty coolant of low temperature and high pressure is passed through a plurality of pipes of the evaporator(70) to be evaporated to get the chamber air heat-exchanged into cold air, and the gas coolant of low temperature and low pressure cooled at the evaporator(70) is sucked into the compressor(120). The aforementioned cooling cycle is repeatedly performed.

At this time, the control unit discriminates whether the chamber temperature detected by the chamber temperature detecting unit is higher than the chamber temperature set by an user. If so, the control unit sends a control signal to turn on the air blowing fan(52) to the air blowing driving element(53). Then, a relay driving element(53) starts the operation of a relay(154) to supply a predetermined level of alternating current voltage (VAC) input from outside to the air blowing fan motor(51).

The air fan motor(51) is subsequently driven to rotate at high speed (for instance, about 3000 rpm) the air blowing fan(52) connected to a rotating shaft. The air blowing fan(52) rotated at high speed discharges the cold air heat-exchanged at the evaporator(70) through the cold air discharging hole(61) and the first cold air pass(150), thereby cooling the freezing chamber(30) and the refrigerating chamber(40).

Here, the temperature of the evaporator(70) is relatively high at an initial operation stage of the compressor(120), where the evaporator(70) does not generate much cold air.

However, there is a problem of the conventional refrigerator in that the air blowing fan(52) is rotated at high speed at an initial operation stage of the compressor(120), so that hot air is blown from the evaporator(70) into the chambers, causing to consume in cooling unnecessary power the chamber temperature to a chamber temperature set by the user.

SUMMARY OF THE INVENTION

Therefore, the present invention is presented to solve the aforementioned problem and it is an object of the present invention to provide a refrigerator driving control apparatus and method thereof which substantially improves the cooling efficiency blown into the chambers and reducing unnecessary power consumption owing to reduction of the time duration to drive compressor.

In accordance with the object of the present invention, there is provided a driving control apparatus of a refrigerator having an evaporator to discharge cold air into chambers by rotation of an air blowing fan as the cold air is generated during circulation of a coolant and an evaporator temperature detecting unit to detect the temperature of the evaporator and to generate a signal related to the evaporator temperature, the apparatus comprising:

a control unit for continuously generating speed control signals to rotate the air blowing fan at a predetermined speed as a driving condition of the air blowing fan is met and for repeatedly sending speed control signals at a predetermined time interval to control the rotation speed of the air blowing fan; and an air blowing fan driving unit for rotating the air blowing fan according to the speed control signals sent from the control unit.

In accordance with another object of the present invention, there is provided a driving control apparatus of a refrigerator, the apparatus further comprising: a control unit, where, if a condition to drive an air blowing fan is met, speed control signals are continuously generated to rotate the air blowing fan at the predetermined low speed, the time duration when the air blowing fan is rotated is counted with a timer, the rotation speed of the air blowing fan is gradually increased at a time interval until the counted time duration is over the predetermined time duration, and the speed control signal is repeatedly sent to keep the rotation speed of the air blowing fan at the predetermined speed to the air blowing fan driving unit for rotating the air blowing fan at the rotation speed related to the speed control signals sent from the control unit.

In accordance with still another object of the present invention, there is provided a driving control method of a refrigerator for discharging the cold air heat-exchanged at an evaporator by a coolant circulated by the operation of a compressor, the method of the apparatus comprising the steps of:

driving the compressor to circulate the coolant;

rotating the air blowing fan if a condition to drive the air blowing fan is formed by comparing the chamber temperature detected by the temperature detecting unit with the temperature set by an user; and repeatedly controlling the rotation speed of the air blowing fan at a predetermined time interval according to the detected evaporator temperature.

In accordance with still another object of the present invention, there is provided a driving control method of a refrigerator for discharging the cold air heat-exchanged at an evaporator by a coolant circulated by the operation of a compressor, the method of the apparatus comprising the steps of:

driving the compressor to circulate the coolant;

rotating the air blowing fan if the condition to drive the air blowing fan is formed by comparing the chamber temperature detected by the temperature detecting unit with the temperature set by an user; and maintaining the rotation speed of the air blowing fan at a constant speed if the time duration is counted for the rotation speed of the air blowing fan to be gradually increased to reach a predetermined speed at a predetermined time interval and if the counted time duration is over a predetermined time duration.

DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

Figure 3:
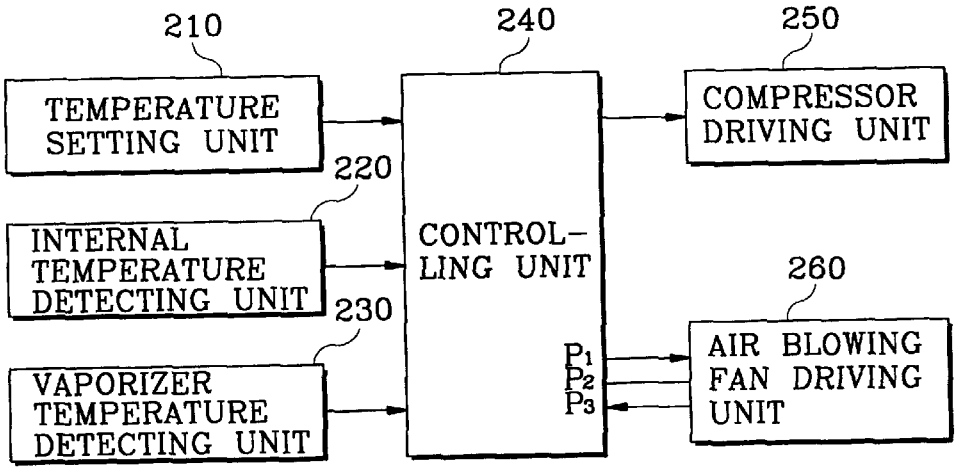
FIG. 3 is a brief block diagram of a refrigerator driving control apparatus in accordance with a preferred embodiment of the present invention.

A preferred embodiment of the present invention is described in detail with accompanying drawings. FIG. 3 is a brief block diagram of a refrigerator driving control apparatus in accordance with a preferred embodiment of the present invention. The refrigerator driving control apparatus comprises: a temperature setting unit(210), a chamber temperature detecting unit(220), an evaporator temperature detecting unit(230), a control unit(240), a compressor driving unit(250) and an air blowing unit(260).

Figure 1:
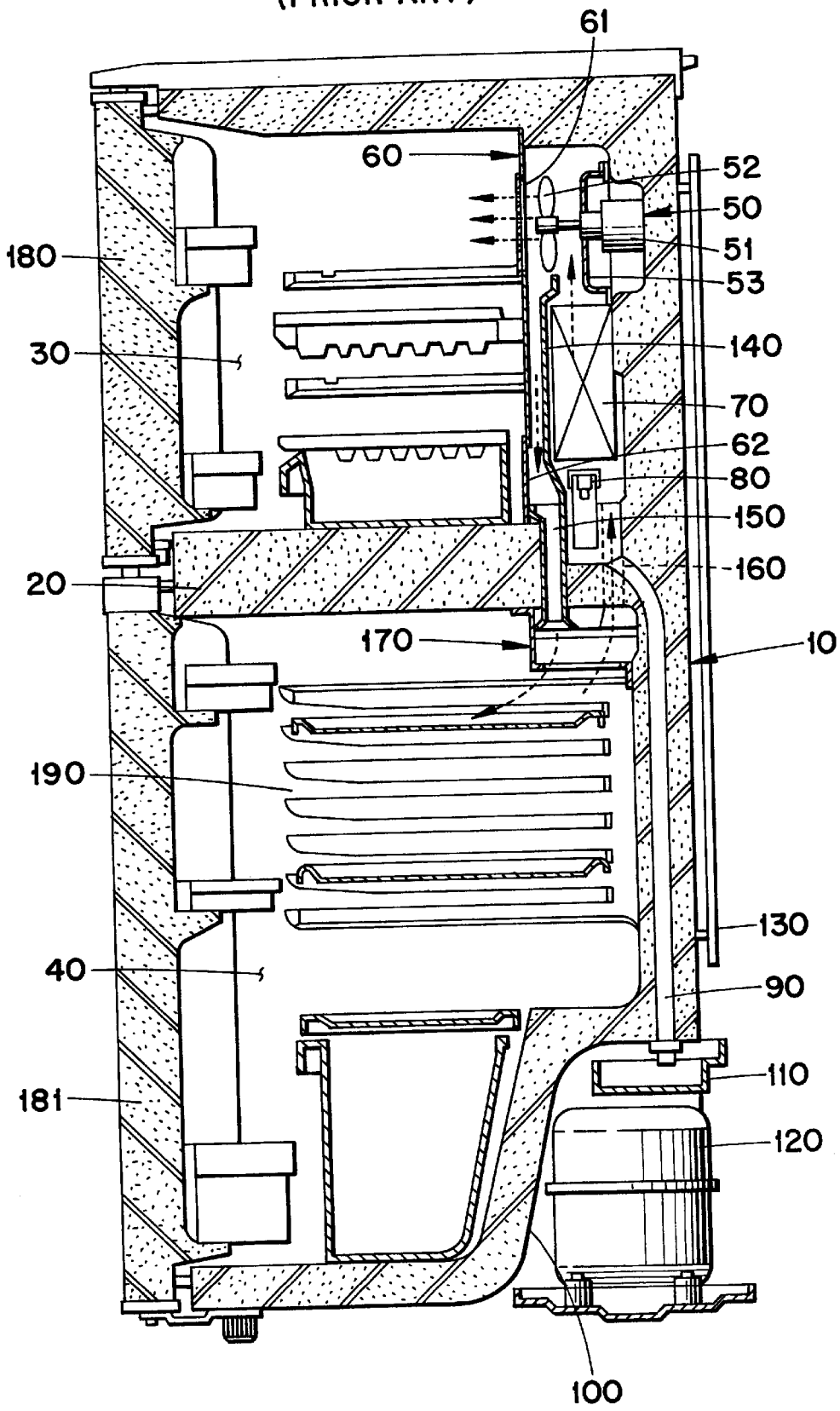
FIG. 1 (PRIOR ART)
FIG. 1 is a longitudinal sectional view for illustrating a conventional refrigerator.
Figure 2:
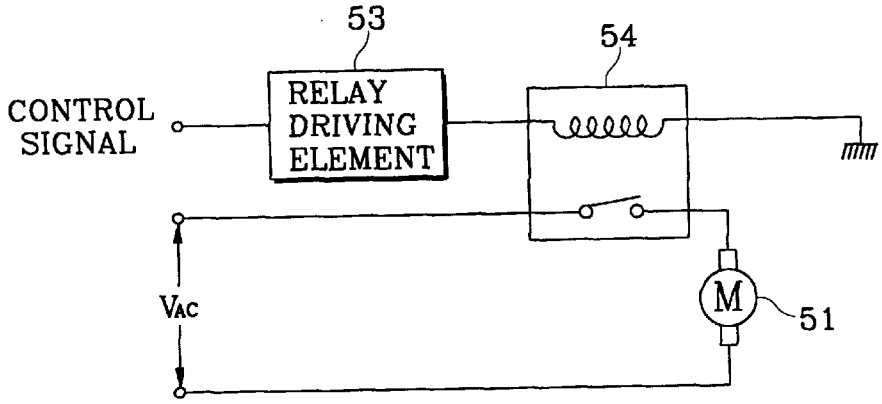
FIG.2 (PRIOR ART)
FIG. 2 is a block diagram for illustrating a circuit to drive an air blowing fan of a conventional refrigerator.

In FIG. 3, the temperature setting unit(210) includes a plurality of keys for setting each temperature of a freezing chamber(30 in FIG. 1) and of a refrigerating chamber(40 in FIG. 40). If a key is selected as desired, a key signal related thereto is sent to the control unit(240), and the chamber temperature detecting unit(220) detects the temperature of chambers and sends a related key signal to the control unit(240).

The evaporator temperature detecting unit(230) detects the temperature of the evaporator(70 in FIG. 1) and sends a related temperature signal to the control unit(240). The control unit(240) compares the chamber temperature set by an user and the chamber temperature detected by the temperature detecting unit(220) and sends a control signal to drive the compressor(120 in FIG. 1) to the compressor driving unit(250) according to the temperature comparison.

In addition, the control unit(240) compares the chamber temperature set by an user and the chamber temperature detected by the temperature detecting unit(220), continuously generates a predetermined duty rate of the pulse width transforming signal to drive the air blowing fan(52 in FIG. 1) according to the aforementioned temperature comparison and sends it to the air blowing fan driving unit(260). In addition, the control unit(240) controls the duty rate of the pulse width transforming signal sent to the air blowing fan driving unit(260) to control the rotation speed of the air blowing fan according to the evaporator(70 in FIG. 1) temperature detected by the temperature signal sent from the evaporator temperature detecting unit(230) and according to the rotation speed of the air blowing fan(52 in FIG. 1) sent back from the air blowing fan driving unit(260). The compressor driving unit(250) includes a compressor(120 in FIG. 1) to drive the compressor according to a signal to drive a compressor.

Figure 4:
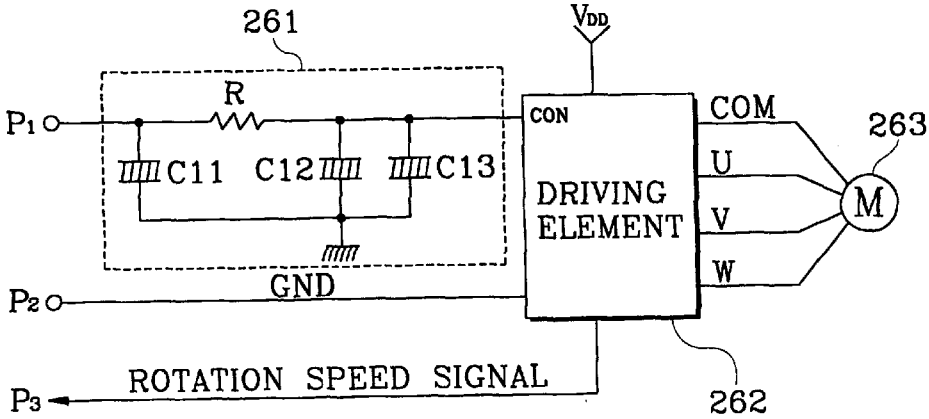
FIG. 4 is a circuit diagram of an air blowing fan driving unit shown in FIG. 3.
Figure 5:
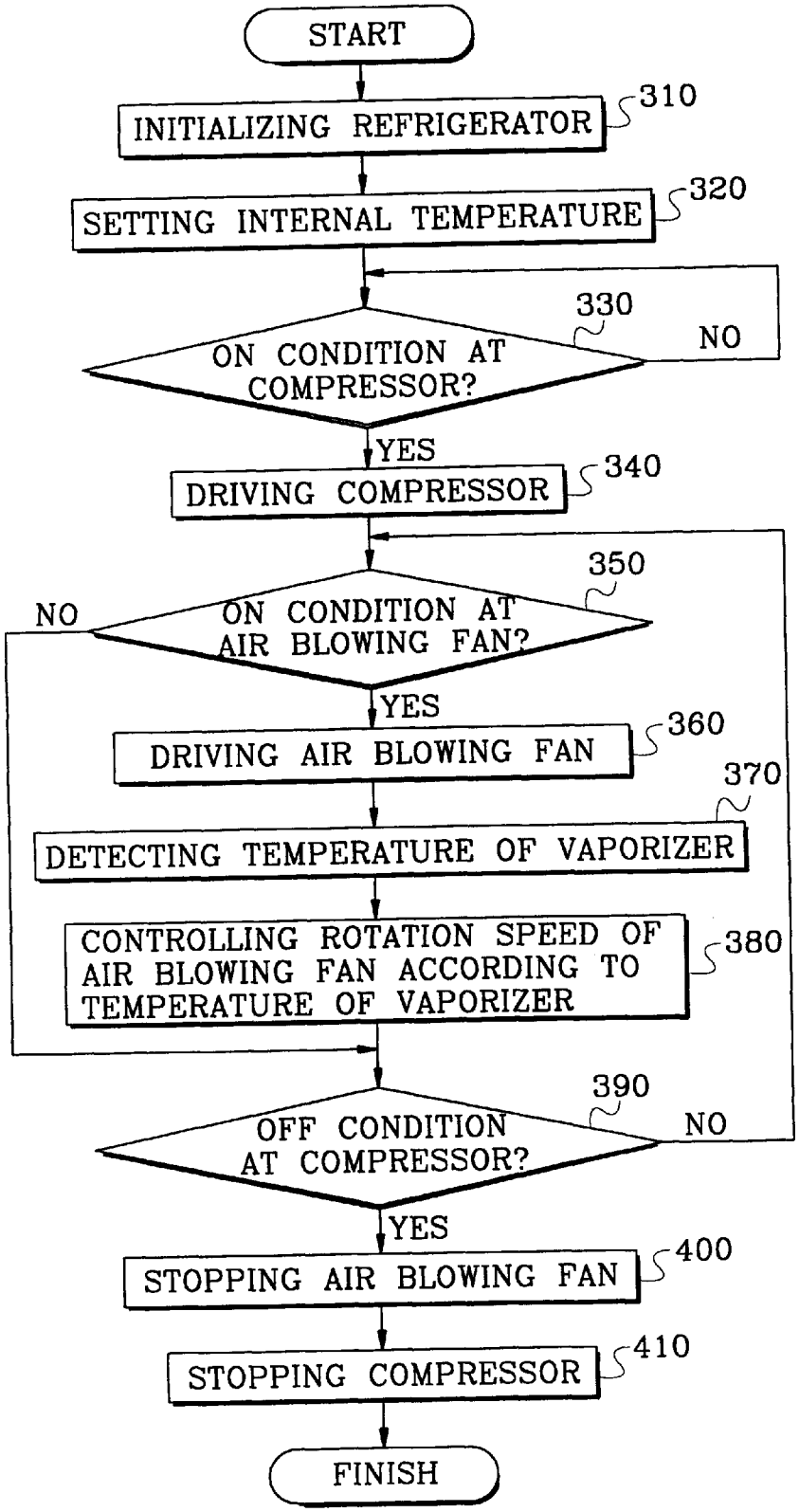
FIG. 5 is a flowchart for illustrating an operational example of a control unit shown in FIG. 3.

In addition, the air blowing fan driving unit(260), as shown in FIG. 4, comprises resistance(R), a signal transforming unit(261) having capacitors (C11, C12 and C13), a driving element(262), a brushless direct current motor(263), and an air blowing fan. The signal transforming unit(261) smoothes the pulse width transforming signal sent from the control unit(240) into direct current power and outputs a voltage signal with the voltage value related to the duty rate of the pulse width transforming signal. The resistance (R) and the capacitor (C11) smooth the pulse width transforming signal output from the control unit(240) into the direct current power having voltage value related to the duty rate of the pulse width transforming signal, and capacitors (C12 and C13) further stabilize the direct current power signal.

The driving element(262) sequentially supplies power to each phase of coil at the brushless direct current motor(263) according to the voltage value of the direct current signal output from the signal transforming unit(261) to drive the brushless direct current motor(263) and to send back the rotation speed signal to the control unit(240).

The rotating effect of brushless direct current motor(263) is generated by the power sequentially sent from the driving element(262) to each phase of coil, thereby rotating the air blowing fan connected by the rotating shaft (not shown).

Hereinafter, a preferred embodiment of the present invention is described in detail with reference to FIGS. 3 through 6. First of all, if commercial alternating current power is applied to a refrigerator, the control unit(240) initializes the refrigerator for its cooling control function (step 310), and the temperature setting unit(210) generates and sends a key signal related to the chamber temperature manually set when a key is selected to set the chamber temperature (step 320).

At this time, the chamber temperature detecting unit(220) and the evaporator temperature detecting unit(230) respectively detect the temperature of the freezing and refrigerating chambers and the evaporator(70 in FIG. 1), generate temperature signals related to the respectively detected temperatures and sends them to the control unit(240). The control unit(240) compares the temperature detected by the chamber temperature detecting unit(220) and the temperature set by the user at step 320 and respectively discriminates whether the compressor is at an ON condition.

Here, the ON condition of the compressor is an operational condition to drive the compressor to cool the freezing and refrigerating chambers, when the chamber temperature detected by the chamber temperature detecting unit(220) is higher than the chamber temperature set by the user.

At this time, if the ON condition of the compressor is met as a result of the discrimination of step 330, in other words, if the detected chamber temperature is higher than the chamber temperature set by the user at step 320, the control unit(240) sends a signal to drive the compressor to the compressor driving unit(250).

If the compressor(120) is driven, the coolant is compressed into the gas coolant of high temperature and high pressure, thereby evaporating the defrosted water collected at the evaporating dish(110) as passing through the condenser. The coolant passed through the condenser(130) is cooled and liquefied into the liquid coolant of low temperature and high pressure as the coolant is heat-exchanged with outside air in natural convection or compulsory convection.

The liquid coolant of low temperature and high pressure is changed into the frosty coolant of low temperature and high pressure which is easy to be evaporated as it is passed through a capillary tube (not shown) where the coolant is expanded to reach evaporating pressure. Then, the frosty coolant is infused into the evaporator(70 in FIG. 1).

Accordingly, the frosty coolant of low temperature and high pressure is passed through a plurality of pipes of the evaporator to be vaporized to get the chamber air heat-exchanged into cold air, and the gas coolant of low temperature and low pressure cooled at the evaporator is sucked into the compressor(120). Then, the aforementioned cooling cycle is repeatedly performed.

The control unit compares the chamber temperature detected by the chamber temperature detecting unit and the chamber temperature set by the user, thereby discriminating whether the air blowing fan(52 in FIG. 1) is at the ON condition (step 350).

At this time, if the chamber temperature detected by the chamber temperature detecting unit(220) is higher than the chamber temperature set by the user, cold air is blown from the evaporator to the chambers where a cooling condition is formed.

As a result of the discrimination of step 350, if the ON condition of the air blowing fan is not met, namely, if the chamber temperature detected by the chamber temperature detecting unit is lower than the chamber temperature set by the user, the flow proceeds to step 390 where the control unit(240) discriminates whether the compressor is at the OFF condition.

As a result of the discrimination of step 350, if the ON condition of the air blowing fan is met, namely, the chamber temperature detected by the chamber temperature detecting unit is higher than the temperature set by the user, the control unit(240) sends to the air blowing fan driving unit(260) a duty rate of a pulse width transforming signal to rotate the air blowing fan at low speed (for instance, 300 rpm) (step 360).

Figure 6:
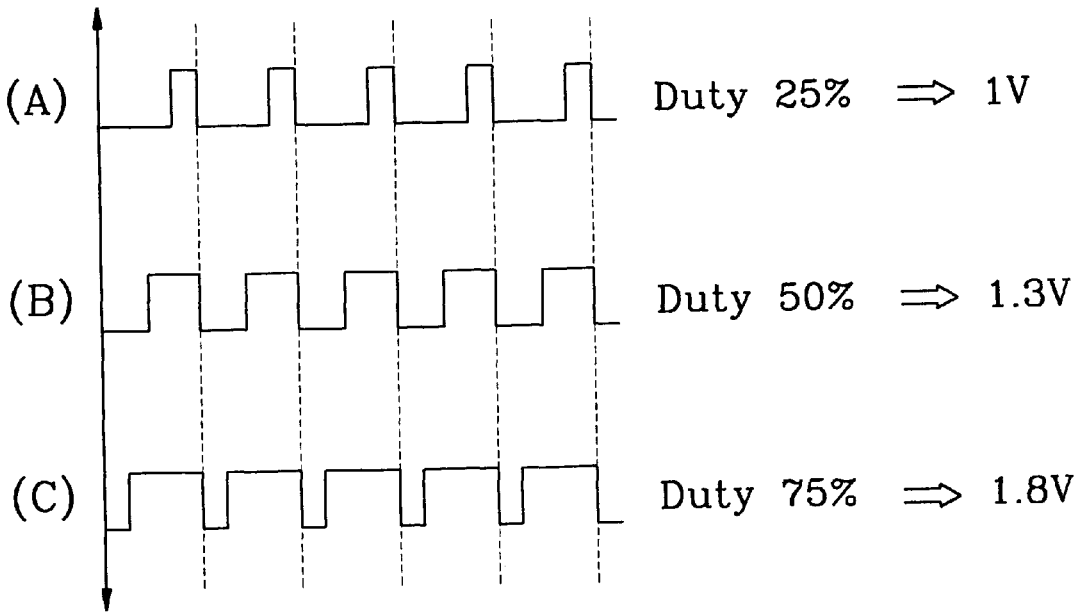
FIG. 6 is a waveform for illustrating an input and output relationship between a control unit and an air blowing fan driving unit.

At this time, the pulse width transforming signal is smoothed at the signal transforming unit(261), is transformed into a voltage level of the direct current signal related to the duty rate thereof and is input to the control terminal (CON.). For example, as shown in FIG. 6, if the duty rate of the pulse width transforming signal output from the control unit(240) is 25%, the voltage level of the direct current signal sent to the control terminal (CON.) of the driving element(262) from the signal transforming unit(261) of the air blowing fan driving unit(260) is 1 Volt [V].

In addition, if the duty rate of the pulse width transforming signal output from the control unit(240) is 50%, the voltage level of the direct current signal sent to the control terminal (CON.) of the driving element(262) from the signal transforming unit(261) of the air blowing fan driving unit (260) is 1.3 Volt [V].

If the duty rate of the pulse width transforming signal output from the control unit(240) is 75%, the voltage level of the direct current signal sent to the control terminal (CON.) of the driving element(262) from the signal transforming unit(261) of the air blowing fan driving unit(260) is 1.8 Volt [V].

According to the voltage level of the direct current signal input to the control terminal (CON.) from the signal transforming unit(261), the driving element (261) of the air blowing fan driving unit(160) drives to rotate the brushless direct current motor(263) at the related rotation speed.

The air blowing fan connected at the rotating shaft (not shown) of the brushless direct current motor(263) is continuously driven by the brushless direct current motor(263) to be rotated at a low speed. The cold air heat-exchanged at the evaporator is discharged through the cold air discharging hole(61 in FIG. 1) and the first cold air pass(150 in FIG. 1) to the freezing chamber(30 in FIG. 1) and to the refrigerating chamber(40 in FIG. 1) to be cooled.

The control unit(240) controls a duty rate of the pulse width signal in comparison of the rotation speed of the brushless direct current motor(263) send back to the driving element(262) of the air blowing fan driving unit(260) and a predetermined rotation speed.

If the rotation speed of the brushless direct current motor (263) is higher than its predetermined rotation speed, the control unit(240) outputs a low duty rate of the pulse width transforming signal to decrease the rotation speed of the brushless direct current motor(263). On the other hand, if the rotation speed of the brushless direct current motor(263) is lower than the predetermined rotation speed, the control unit(240) outputs a high duty rate of the pulse width transforming signal to increase the rotation speed of the brushless direct current motor(263).

The control unit(240) detects the evaporator temperature according to the temperature signal sent from the evaporator temperature detecting unit(230) (step 370) and sends the duty rate of the pulse width transforming signal to the air blowing fan driving unit(260) for controlling the rotation speed of the air blowing fan according to the detected temperature of the evaporator.

At this time, the duty rate of the pulse width transforming signal is to be decreased if the temperature of the evaporator is high. Then, the voltage level of the direct current signal input to the control terminal (CON.) of the driving element (262) from the signal transforming unit(261) of the air blowing fan driving unit(260) is decreased, so that the rotation speed of the brushless direct current motor(263) is decreased along with the decreased rotation speed of the air blowing fan.

The duty rate of the pulse width transforming signal is to be increased if the detected evaporator temperature is low. Then, the voltage level of the direct current signal input from the signal transforming unit(261) of the air blowing fan driving unit(260) to the control terminal (CON.) of the driving element(262) is increased along with the increased rotation speed of the air blowing fan.

The duty rate of the pulse width transforming signal is to be decreased as the detected evaporator temperature increased. Then, the voltage level of the direct current signal input from the signal transforming unit(261) of the air blowing fan driving unit(260) to the control terminal (CON.) of the driving element(262) is decreased along with the decreased rotation speed of the air blowing fan.

In addition, the duty rate of the pulse width transforming signal is to be kept constant if the detected evaporator temperature reaches a predetermined minimum temperature. Then, the voltage level of the direct current signal input from the signal transforming unit(261) of the air blowing fan driving unit(260) to the control terminal (CON.) of the driving element(262) is kept constant along with the constant rotation speed of the air blowing fan.

The control unit(240) detects the chamber temperature according to the temperature signal sent from the chamber temperature detecting unit(220) and compares the detected chamber temperature and the set chamber temperature to discriminate whether the compressor is at its OFF condition (step 390).

Here, the OFF condition of the compressor is when the chamber temperature detected by the chamber temperature detecting unit(220) is lower than the chamber temperature set by the user at step 320, wherein the operation of the compressor is stopped to cease circulation of the coolant, thereby stopping the cooling operation.

As a result of the discrimination at step 390, if the OFF condition of the compressor is not met, namely if the chamber temperature detected is higher than the chamber temperature set by the user at step 320, the flow returns to step 350 and the repeated operations subsequent to step 350 are performed.

At an initial operation stage of the compressor the evaporator temperature is relatively high, the air blowing fan is rotated at low speed. The rotation speed of the air blowing fan is gradually increased as the evaporator temperature decreases to the minimum temperature. At this time, the rotation speed of the air blowing fan is kept constant (at about 3000 rpm) to maximize the cooling efficiency of the evaporator.

As a result of the discrimination at step 390, if the OFF condition of the compressor is met, namely if the chamber temperature detected is lower than the chamber temperature set by the user at step 320, the control unit(260) stops sending the pulse width signal to the air blowing fan driving unit(260) to stop rotating the air bowing fan (step 400).

Therefore, the output of the direct current signal from the signal transforming unit(261) of the air blowing fan driving unit(260) is stopped, whereby the driving element(262) stops inputting the power to each phase of the brushless direct current motor(263) and the air blowing fan also stops its rotation.

The control unit(240) sends a signal to stop driving the compressor to the compressor driving unit(250) (step 410), which stops supplying the power according to the signal from the control unit(240). The circulation of the coolant is, then, stopped to cease the cooling operation of the chambers as heat-exchange does not occur at the vaporizer.

Figure 7:
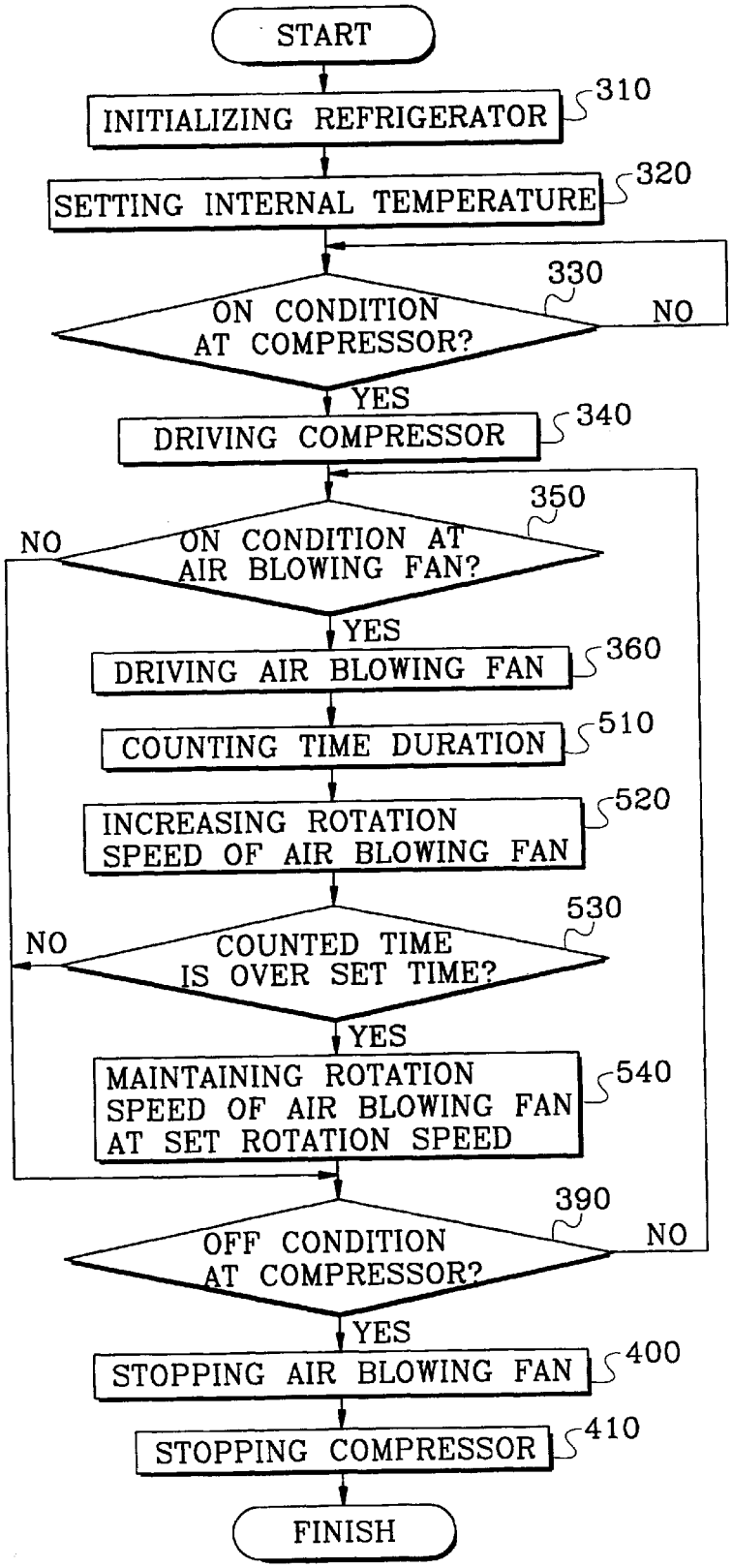
FIG. 7 is a flowchart for illustrating another operational example of a control unit shown in FIG. 3.

On the other hand, another embodiment of the present invention is described in detail with reference to FIG. 7. Throughout the drawing, like reference numerals and symbols are used in FIG. 5 for designation of like or equivalent parts and the operational procedures for simplicity of illustration and explanation, and redundant references will be omitted.

First of all, the control part(240) carries out steps 310 through 360, whereby the compressor is driven to circulate a coolant, and the evaporator is heat-exchanging. As the air blowing fan is rotated at low speed (at about 300 rpm), the control unit(240) starts to count the time duration with a embedded timer (step 510). In order to increase the rotation speed of the air blowing fan to a predetermined speed, the duty rate of the pulse width transforming signal sent to the air blowing driving unit(260) is increased to the predetermined rate (step 520).

As the voltage level of the direct current input from the signal transforming unit(261) of the air blowing fan driving unit(260) to the control terminal (CON.) of the driving element(262) is increased to the predetermined level, the rotation speed of the brushless direct current motor(263) is increased to a predetermined speed along with the increased rotation speed of the air blowing fan.

The control unit(240) checks the time duration counted by the timer and discriminates whether it is over the predetermined time duration (about 2 minutes) (step 530). Here, the predetermined time duration is the time value taken the evaporator temperature to reach the minimum temperature.

As a result of the discrimination at step 530, if the time duration counted with the timer is under the predetermined time duration, the evaporator temperature has not reached to its minimum temperature. Therefore, the flow proceeds to step 390 where it is discriminated whether the compressor is at its OFF condition.

If the time duration counted is over the predetermined time as a result of the discrimination at step 530, the evaporator temperature reaches to its minimum temperature. Therefore, the duty rate of the pulse width transforming signal sent to the air blowing fan driving unit(260) is kept constant to keep the rotation speed of the air blowing fan constant for blowing cold air heat-exchanged at the evaporator (step 540).

The voltage level of the direct current signal input from the signal transforming unit(261) of the air blowing fan driving unit(260) to the control terminal (CON.) of the driving element(262) is kept constant according to the duty rate of the pulse width transforming signal, and the driving element(262) keeps the rotation speed of the brushless direct current motor(263) at its adequate speed (for instance, 3000 rpm). Therefore, the rotation speed of the air blowing fan is kept constant at its adequate speed.

The control unit(240) detects the chamber temperature according to the temperature signal sent from the chamber temperature detecting unit(220) and compares the detected chamber temperature and the chamber temperature set at step 320 to discriminate whether the compressor is at its OFF condition (step 390).

As a result of the discrimination at step 390, if the OFF condition of the compressor is not met, namely the chamber temperature detected by the chamber temperature detecting unit(220) is higher than the chamber temperature set by the user at step 320, the flow returns to step 350 and repeated operations subsequent to step 350 to step 360 to step 510 to step 540 to step 390 are performed.

At that time, the air blowing fan is rotated at the initial rotation speed (for instance, 300 rpm) plus an increased portion of the rotation speed at step 520 (for instance, 300 rpm+an increased portion of the rotation speed). Thus, the evaporator temperature is relatively high at the initial stage where the compressor is to be driven.

As the compressor is driven longer, the evaporator temperature is continuously decreased to a predetermined minimum temperature. Therefore, the rotation speed of the air blowing fan is gradually increased until it is over the experimentally counted time duration. It is considered that the evaporator temperature reaches to its minimum temperature during the experimental time duration.

If the experimentally counted (predetermined) time duration has passed, it is confirmed that the evaporator temperature reaches at its minimum temperature, and the rotation speed of the air blowing fan is kept at its adequate speed (for instance, 3000 rpm) where the cold air heat-exchanged at the evaporator is to be blown into the chambers, thereby maximizing the cooling efficiency of the evaporator.

As a result of the discrimination at step 390, if the compressor is at its OFF condition, the control unit(240) stops cooling the chambers as circulation of the coolant is stopped as the operations of the air blowing fan and the compressor are stopped at steps 400 through 410, as described above.

At the initial operation stage of the compressor, the evaporator temperature is relatively high, and the air blowing fan is rotated at a low speed. The rotation speed of air blowing fan is gradually increased as the evaporator temperature decreases to the predetermined minimum temperature, where the rotation speed of the air blowing fan is kept constant (at about 3000 rpm) to maximize the cooling efficiency of the evaporator, thereby improving the cooling efficiency of the cold air blown into the chambers and reducing power consumption owing to reduction of the time duration to drive the compressor.

What is claimed is:

1. A driving control apparatus of a refrigerator having a food storage chamber, an air blowing fan, an evaporator to discharge cold air into the chamber by rotation of the air blowing fan as the cold air is generated during circulation of a coolants and a fan driving unit for rotating the air blowing fan, wherein the driving control apparatus comprises:

a control unit connected to the fan driving unit for generating speed control signals to rotate the air blowing fan initially at a low speed and thereafter at a progressively increasing speed, the increasing fan speed being independent of a temperature of the chamber.

2. The apparatus as defined in claim 1, wherein the air blowing fan driving unit comprises:

a signals transforming unit for transforming the speed control signal sent from the control unit into a related voltage level of a direct current signal; and a driving element of the brushless direct current motor connected to the signal transforming unit to be rotated at the rotation speed relatedly to a voltage value of the direct current signal sent from the signal transforming unit.

3. A driving control method of a refrigerator for discharging food storage chamber, the cold air heat-exchanged at an evaporator by the coolant circulated by the operation of a compressor, wherein the method of the apparatus comprises the steps of:

A) driving the compressor to circulate the coolant;

B) rotating the air blowing fan if a condition to drive the air blowing fan is determined by comparing a food storage chamber temperature with a reference temperature set by a user; and C) rotating the air blowing fan initially at a low speed and thereafter at a progressively increasing speed, the increasing fan speed being independent of a temperature of the food storage chamber.

4. The apparatus according to claim 1 further including an evaporator temperature detecting unit for detecting the temperature of the evaporator and generating a signal related to the evaporator temperature, the control unit connected to the evaporator temperature detecting unit to progressively increase the fan rotating speed in response to decreases in the detected evaporator temperature.

5. The apparatus according to claim 1 further including a timer for counting a time period following an initial driving of the air blowing fan, the control unit connected to the timer for stopping the progressive increasing of fan speed when the counted time period reaches a predetermined value.

6. The method according to claim 3 further including the step of detecting a temperature of the evaporator, and step C including progressively increasing the fan speed in response to decreases in the detected evaporator temperature.

7. The method according to claim 3 further including the step of counting a time period following an initial driving of the fan, and step C including stopping the progressive increasing of fan speed when the counted time period reaches a predetermined value.

* * * * *